US008444114B2

(12) United States Patent
Rivard

(10) Patent No.: US 8,444,114 B2
(45) Date of Patent: May 21, 2013

(54) ANCHORAGE EXTRACTOR

(76) Inventor: Gilles Rivard, L'Assomption (CA)

( * ) Notice: Subject to any disclaimer, the term of this patent is extended or adjusted under 35 U.S.C. 154(b) by 57 days.

(21) Appl. No.: 12/791,716

(22) Filed: Jun. 1, 2010

(65) Prior Publication Data

US 2010/0301289 A1 Dec. 2, 2010

(30) Foreign Application Priority Data

Jun. 1, 2009 (CA) ..... 2668501

(51) Int. Cl.
*E04H 17/26* (2006.01)
*B66F 11/00* (2006.01)
*E02D 13/02* (2006.01)

(52) U.S. Cl.
USPC ..... 254/30; 254/112; 254/111; 254/6 R

(58) Field of Classification Search
USPC ..... 254/109, 112–116, 118, 123, 124, 254/130–132, 134, 199, 205, 21, 230, 237, 254/29 R, 2 B, 30, 4 B, 4 R, 5 B, 5 R, 6 B, 254/6 R, 8 B, 8 R, 95, 97, DIG. 1; 269/17; 74/422
See application file for complete search history.

(56) References Cited

U.S. PATENT DOCUMENTS

| | | | | | |
|---|---|---|---|---|---|
| 303,504 | A | * | 8/1884 | Garcin | 254/97 |
| 519,821 | A | * | 5/1894 | Rouse | 254/230 |
| 560,056 | A | * | 5/1896 | Arnold | 254/95 |
| 751,613 | A | * | 2/1904 | Cook | 254/97 |
| 769,048 | A | * | 8/1904 | Bebler | 254/23 |
| 812,131 | A | * | 2/1906 | Hoekstra | 254/30 |
| 968,312 | A | * | 8/1910 | Bacon | 254/97 |
| 986,868 | A | * | 3/1911 | Schofield | 254/230 |
| 1,147,525 | A | * | 7/1915 | Martin | 254/237 |
| 1,199,112 | A | * | 9/1916 | Rees | 254/230 |
| 1,435,884 | A | * | 11/1922 | Stone | 254/97 |
| 2,520,427 | A | * | 8/1950 | Nelson | 254/131 |
| 2,604,300 | A | | 7/1952 | Polselli et al. | |
| 2,637,523 | A | * | 5/1953 | Lucker | 254/99 |
| 3,254,876 | A | | 6/1966 | Powell | |
| 3,526,387 | A | * | 9/1970 | Fleming | 254/30 |
| 3,556,482 | A | * | 1/1971 | Whitney | 254/134 |
| 3,671,015 | A | * | 6/1972 | Sullivan | 254/332 |
| 3,674,239 | A | | 7/1972 | Wirtgen | |
| 3,802,663 | A | | 4/1974 | Widegren et al. | |
| 4,112,530 | A | | 9/1978 | Lecce et al. | |
| 4,354,375 | A | * | 10/1982 | Lesowsky | 72/449 |
| 5,390,914 | A | * | 2/1995 | Schroeder | 473/483 |
| 6,302,377 | B1 | * | 10/2001 | Pimentel | 254/30 |
| 7,611,126 | B2 | * | 11/2009 | Vesa | 254/93 H |
| 2005/0028286 | A1 | * | 2/2005 | Smart | 5/655 |
| 2006/0231343 | A1 | * | 10/2006 | Vesa | 187/233 |

FOREIGN PATENT DOCUMENTS

| | | |
|---|---|---|
| GB | 2423759 | 6/2006 |

* cited by examiner

*Primary Examiner* — Lee D Wilson
*Assistant Examiner* — Tyrone V Hall, Jr.
(74) *Attorney, Agent, or Firm* — Brouillette & Partners; François Cartier; Robert Brouillette

(57) ABSTRACT

The present invention is directed to an anchorage extractor. The extractor is used to remove post, anchorage or stake from the ground without using a force generated by a motor. The anchorage extractor comprises a base disposed on the ground to provide a stable support. A lever is connected to a driving wheel that is connected to a rack. The anchorage is attached to the rack and when the lever is actuated, the drive wheel drives the rack upward, removing the anchorage from the ground. An advantage of the present invention is that the direction of the extraction force is parallel to the anchorage axis by adjusting the angle of the extractor. The extractor may be folded on itself or dismantled to be transported.

12 Claims, 9 Drawing Sheets

ANCHORAGE EXTRACTOR

CROSS-REFERENCE TO RELATED APPLICATIONS

The present patent application claims the benefits of priority of commonly assigned Canadian Patent Application no. 2,668,501, entitled "Extracteur d'ancrage à angle variable" and filed at the Canadian Patent Office on Jun. 1, 2009.

FIELD OF THE INVENTION

The present invention is related to device used to remove anchorage or the like from the ground.

BACKGROUND OF THE INVENTION

The present invention is related to devices used to remove anchorage or post inserted in the ground. Currently, non-motorized or motorized devices are used for this purpose, but users of these devices are rather dissatisfied with the performance or conditions of use.

Regarding the motorized devices, their advantage is the strength that can be generated but they are often bulky and heavy and consequently difficult to handle. In the specific environment of the assembly and dismantling of marquees or capital, hooks or anchorages used to secure the capital are often placed in confined spaces and a large device is awkward to use. These devices also require fuel to operate. Moreover, it is necessary to provide special equipment, such as a truck or trailer for moving these devices because of their size and weight.

The non-motorized devices that are currently used provide a limited force and a substantial effort is required from the user to remove the anchorages that are fixed in the ground. Indeed, the anchorages used to fix capitals are often inserted using pneumatic systems and in grounds such as asphalt or pavement composed of different materials pressed mechanically. Thus, these anchorages are firmly anchored in the ground. In addition, multiple anchorages are sometimes used, multiple anchorages are composed of a L-shaped structure which comprises several holes to receive several anchorages. Each of the anchorage is inserted individually in one of the hole of the L-shaped structure and the different anchorages will not have exactly the same orientation relatively to the ground. The different orientation of each of the anchorages creates a very high resistance to remove them all at the same time by exerting a force on the L-shaped structure. Because of this, each anchorage must be removed individually.

There is thus a need for a non-motorized device that has the advantages of both types of devices currently used, non-motorized and motorized. These advantages are ease of use, lightness of the system and the extraction force of the system independent of the strength of the user.

OBJECTS OF THE INVENTION

A first object of this invention is to provide a non-motorized extractor for anchorages.

A second object of this invention is to provide a non-motorized extractor developing a large extraction force.

Another object of the invention is to provide an extractor that may be positioned at different angles.

A fourth object of this invention is to provide an extractor having an extraction force that is generally independent of the strength of the user.

Another object of this invention is to provide an anchorage extractor that is easily transportable.

Another object of this invention is to provide an anchorage extractor that is foldable or that may be dismantled.

SUMMARY OF THE INVENTION

The aforesaid and other objectives of the present invention are realized by generally providing an extractor for anchorages or the like, the anchorages being installed in the ground and the anchorages having a longitudinal axis, the extractor comprising: a main body; a rack slidably connected to the main body; a shaft rotatively connected to the main body; a sprocket connected to the shaft, the sprocket cooperating with the rack; a first lever, wherein the actuation of the first lever cause the rotation of the shaft and of the sprocket; a connector adapted to cooperate with the anchorage, the connector being connected to the rack; a base connected to the main body, the base being in contact with the ground; wherein the actuation of the first lever drives the sprocket, and wherein the sprocket drives the rack upwardly and the rack pulls and remove the anchorage from the ground.

In a preferred embodiment, the extractor further comprises a driving wheel, the driving wheel being connected to the shaft, the driving wheel being rotated by actuating the first lever. The extractor further comprise a first lever-lock cooperating with the driving wheel, wherein the actuation of the first lever cause the first lever-lock to rotate the driving wheel, and wherein the first lever-lock transmit the rotation of the driving wheel to the shaft. The extractor comprises a second lever to release the first lever-lock. The extractor further comprises a second lever-lock cooperating with the driving wheel, the second lever-lock blocking the rotation of the driving wheel. The extractor comprises a release lever, the release lever releasing the second lever-lock from blocking the rotation of the driving wheel.

In a still further embodiment, aforesaid and other objectives of the present invention are realized by generally providing an extractor for anchorages or the like, the anchorages being installed in the ground and the anchorages having a longitudinal axis, the extractor comprising a main body, the main body having an elongated shape comprising a elongated cavity, wherein the main body may be disposed parallely to the longitudinal axis of the anchorage; a rack slidably connected into the cavity of the main body; a driving mechanism comprising: a shaft rotatively connected to the main body; a driving wheel connected to the shaft; a sprocket connected to the shaft, the sprocket cooperating with the rack; a first lever; a first lever-lock, the first lever-lock cooperating with the driving wheel, wherein the actuation of the first lever causes the first lever-lock to rotate the driving mechanism; a base connected to the main body, the base being in contact with the ground; a guiding member having an elongated shape, the guiding member being connected to the main body; a sliding structure adapted to slide along the guiding member, the sliding structure comprising an opening to receive the guiding member; a plurality of positioning holes, each of the positioning hole corresponding to an angular position of the main body; a locking member having an elongated shape, the locking member being adapted to cooperate with the positioning holes; wherein the actuation of the first lever drives the driving mechanism, and wherein the driving mechanism drives the rack.

The possibility to position the extractor at an angle substantially parallel to that of the anchorage provides a device that is more efficient. Indeed, when a force perpendicular to the ground is applied to remove an anchorage that is not perpendicular to the ground, only the force component that is in the same axis as the longitudinal axis of the anchorage is involved in the extraction. If the extraction force is applied in the same axis as the longitudinal axis as the anchorage, almost all this force acts as a force for extraction. Consequently, the device works more efficiently. The extractor of the present invention comprises a system to modify the angle of the main body. An example of such a system is illustrated later.

The support surface of the base of the anchorage extractor must be large enough to provide increased stability during extraction and thus prevent the extractor base to be destabilized during use. A triangular shape for the base of the support surface provides a good lateral stability. In addition, the support surface provided by the base is constant regardless of the angle of the main body. It is however to be understood that the shape of the base is not limited to a triangle and could be rectangular, polygonal, etc. . . . without departing from the scope of the present invention.

The device described in the present invention includes security mechanisms that are operated by levers or handles by the user. It is important to note that these security mechanisms are an example and they could be embodied by a different mechanism with the same utility, i.e. that will lock the extractor in a selected position.

The anchorages in the present invention may be devices inserted into the ground to keep objects in place or to provide an attachment point. These anchorages can be stakes for signs, anchorages for tents. It may also be, for example, stakes for trees, tent pegs, anchorages for tent, etc. . . . It should be noted that the extractor can be used to remove other devices inserted into the ground without limiting to the previous examples.

It has been experienced that the anchorage extractor as described in the present invention can develop sufficient strength to remove multiple anchorages as the one used for big size capitals. The multiple anchorage is a L-shaped structure having multiple holes, each hole adapted to receive an individual anchorage. A large force is required to remove the multiple anchorages, indeed, when the individual anchorages are positioned in the ground at different angles, the force required to remove them all at the same time is greater. Also, the anchorages for capitals are often inserted in grounds that are very compact, such as rocky grounds, asphalt, etc. . . .

The anchorage extractor can be made of metal or polymer having sufficient rigidity to withstand the forces transmitted during the extraction of anchorages. Aluminum, for example, is a good choice because it offers strength and lightness.

The features of the present invention which are believed to be novel are set forth with particularity in the appended claims.

BRIEF DESCRIPTION OF THE DRAWINGS

The above and other objects, features and advantages of the invention will become more readily apparent from the following description, reference being made to the accompanying drawings in which.

DETAILED DESCRIPTION OF THE PREFERRED EMBODIMENT

A novel anchorage extractor will be described hereinafter. Although the invention is described in terms of specific illustrative embodiment(s), it is to be understood that the embodiment(s) described herein are by way of example only and that the scope of the invention is not intended to be limited thereby.

Figure 1:
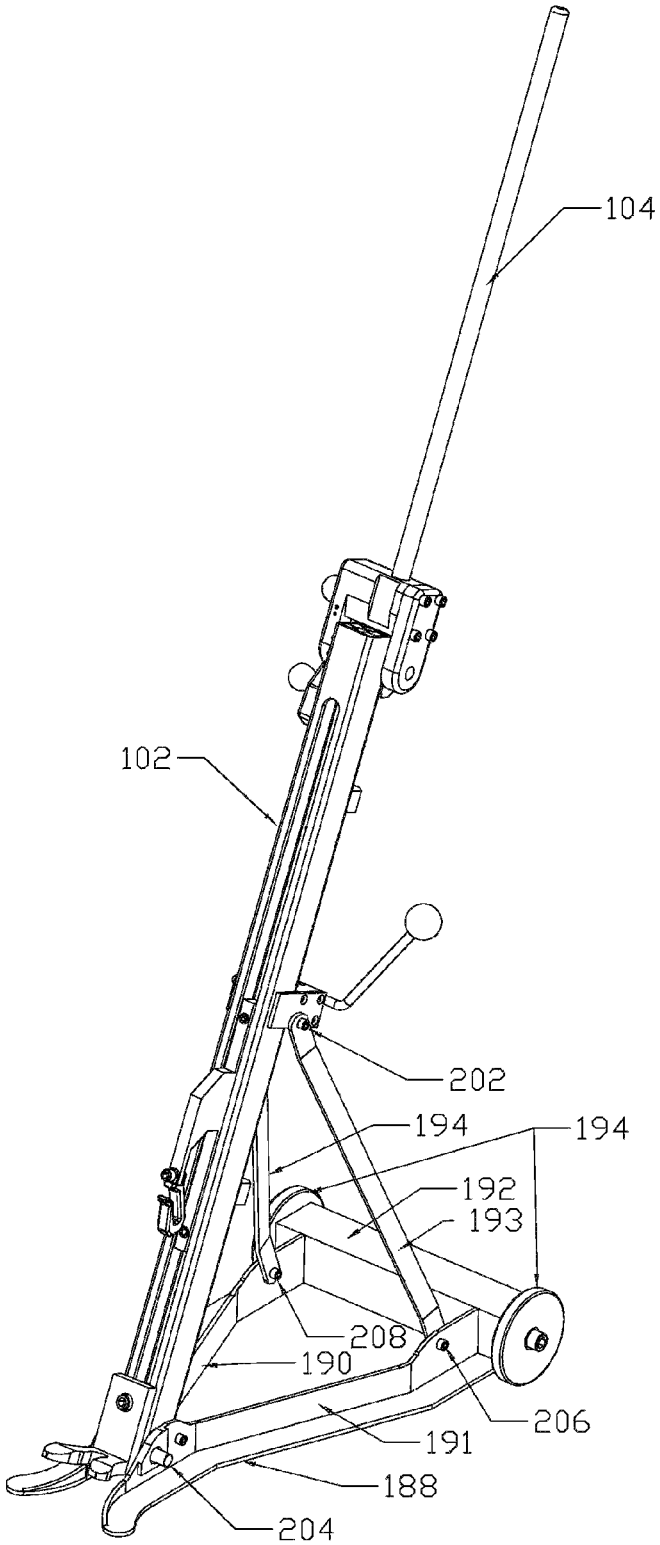
FIG. 1 is a perspective view of the anchorage extractor.
Figure 2A:
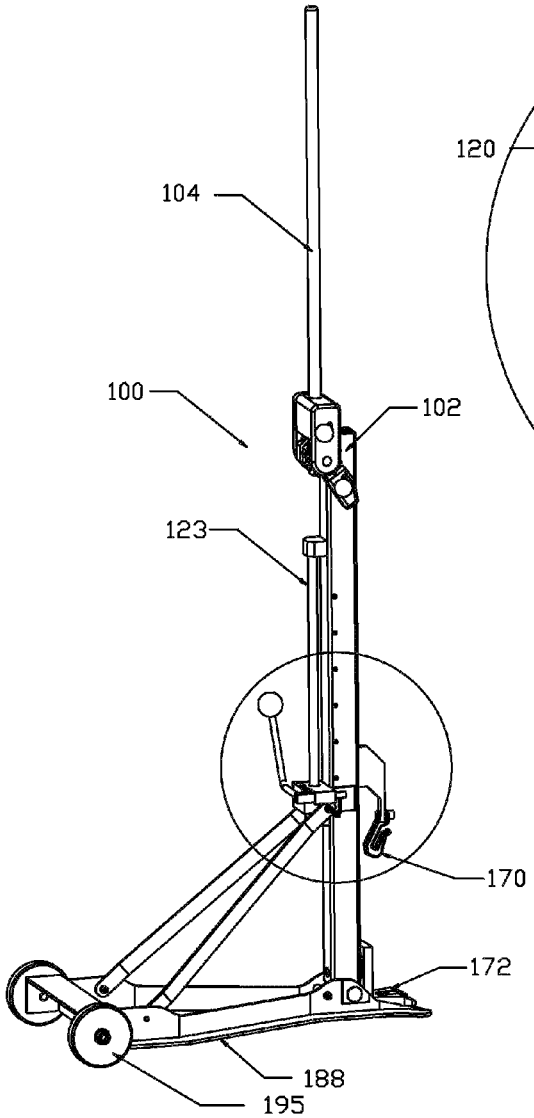
FIG. 2*a* is a perspective view of the anchorage extractor.
Figure 2B:
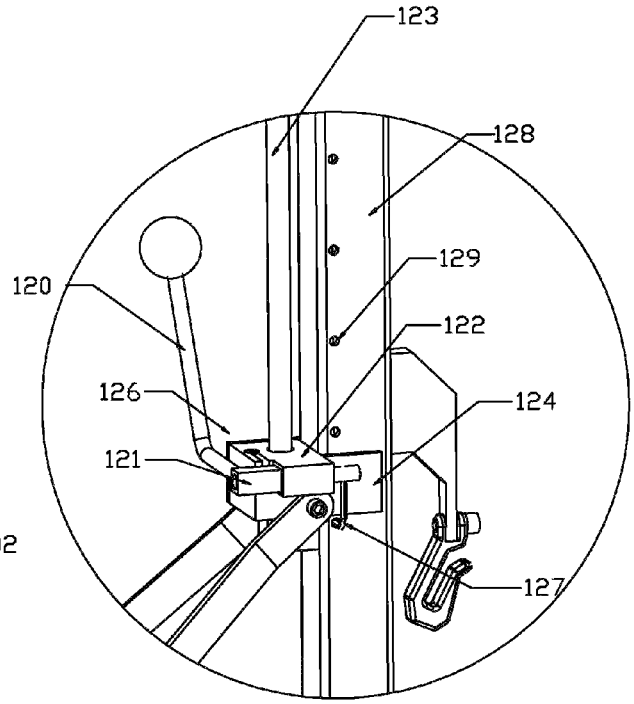
FIG. 2*b* is an enlarged view of a portion of FIG. 2*a*.
Figure 3A:
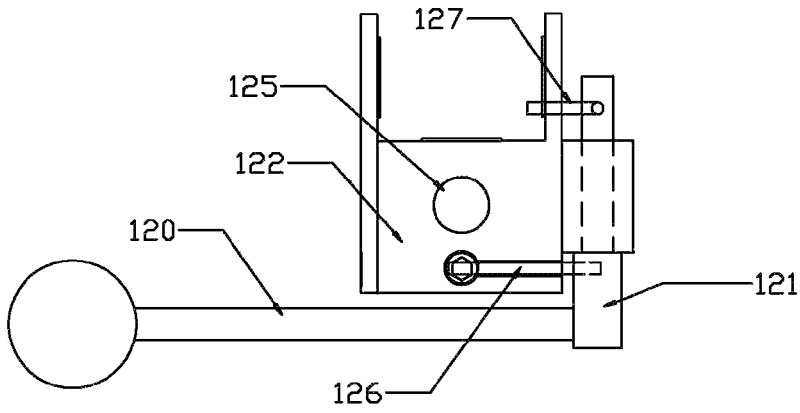
FIG. 3 is a top view of the safety mechanism of the anchorage extractor.
FIG. 3*b* is a perspective view of the safety mechanism of the anchorage extractor.
FIG. 3*c* is a perspective view of the position selector.
Figure 3B:
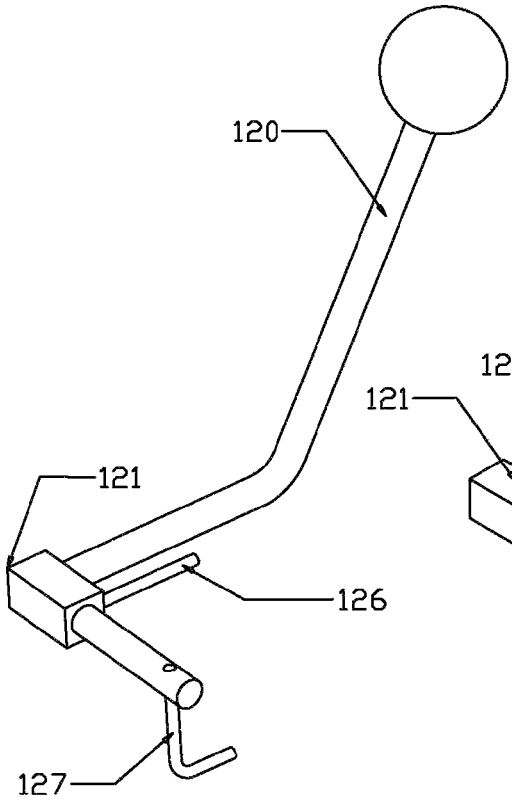
Figure 3C:
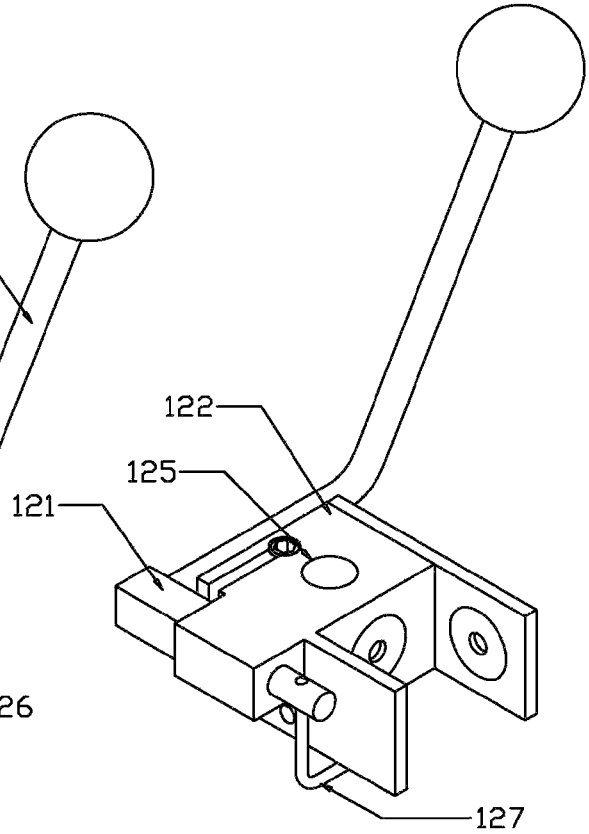

As shown in FIG. 1, the anchorage extractor includes a first lever 104, a main body 102 and a base 188. The base 188 is formed, in this embodiment, by a first and a second section 190 and 191 which are arranged in a "V" shape or triangular shape one relative to another. These two sections 190 and 191 are connected by a third section 192 on which are fixed wheels 195. Two pivoting members 193 and 194 are connected to the base and the main body 102, the first extremity pivotally connected to the sliding structure and the second extremity connected to the base. The connections between members 193 and 194 with the base 188 and the main body 102 are of the pivot type, to change the angular position of the main body 102 relatively to the base 188. The shape of the base 188 includes an enlarged portion (section 192) which provides a stable support surface when the anchorage extractor is in use. It should be noted that the base may have a shape other than triangular, the important aspect being to have a support surface sufficiently large and stable.

To minimize the space occupied when the anchorage extractor is not used, it can preferably be folded on itself or disassembled. As illustrated in FIG. 1, the main body 102, the base 188 and the pivoting members 193 and 194 are fixed to each other by using pivot connections 202, 204, 206 and 208. By dismantling one or more of these connections it is possible to fold or disassemble the anchorage extractor. For example, if the pivot connection 202 or the pivoting members 193 and 194 are dismantled, the main body 102 can be disposed or folded on the base 188. The pivot connections are typically composed of a rod with a bolt at each end to connect the main body 102, the base 188 and the pivoting members 193 and 194.

The main body 102 of the anchorage extractor 100 can be positioned in the same axis or almost the same as the longitudinal axis of the anchorage or stake to remove. A first embodiment of the mechanism for changing the angle of the main body is illustrated in FIGS. 2*a*, 2*b*, 3*a*, 3*b* and 3*c*. It includes a sliding structure 122, an angle selector 120, a transmission member 121, a locking rod or member 127, a guiding member 123, positioning plates 124 and a security device 126. The angular position selector 120 is connected to the transmission member 121 which is itself connected to a locking member 127. The sliding structure includes a hole 125 which is adapted to receive the guiding member 123. The plates 124 extend on both sides of the main body 102. The transmission member 121 is partially contained in the sliding structure 122. The security device 126, in a locked position, is partially inserted into the transmission member 121, preventing the angle of the anchorage extractor to change during its use.

To change the angle of the main body 102, the security device 126 is held in unlocked position and the angle selector 120 is activated. When the angle selector 120 is activated, it releases the locking member 127 and the sliding structure 122 is displaced along the main body 102. The positioning plates 124 maintain the lateral position of the sliding structure 122. When the angular position of the main body 102 is reached, the angle selector 120 is released and the locking member 127 is repositioned to its locked position, i.e. in one of the holes designed to receive the locking member 127. The surface 128 of main body 102, adjacent to the locking member 127, comprises the positioning holes 129. Each of these positioning holes 129 correspond to an angular position of the main body 102. The number of positioning holes 129 determines the number of possible angular positions of the main body 102.

Figure 4:
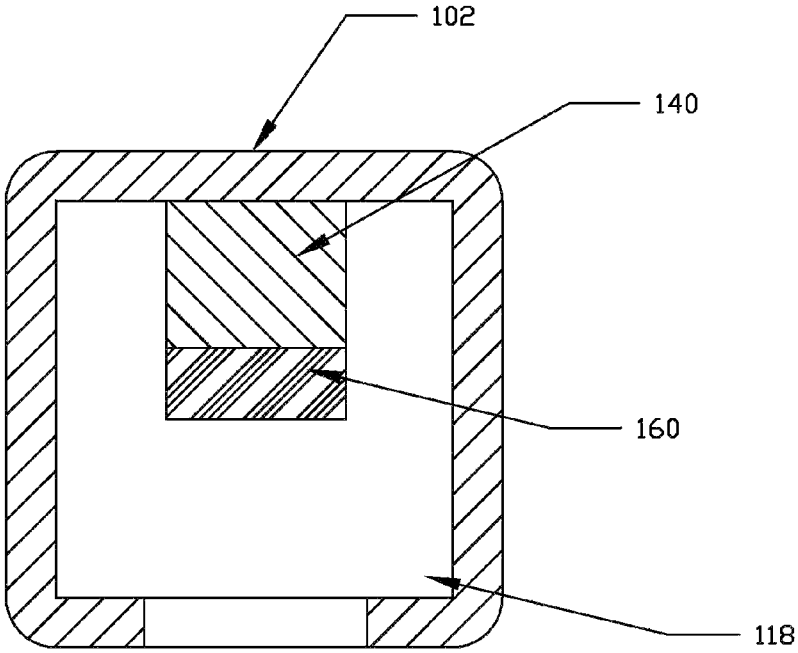
FIG. 4 is a schematic sectional view of the main body.
Figure 10:
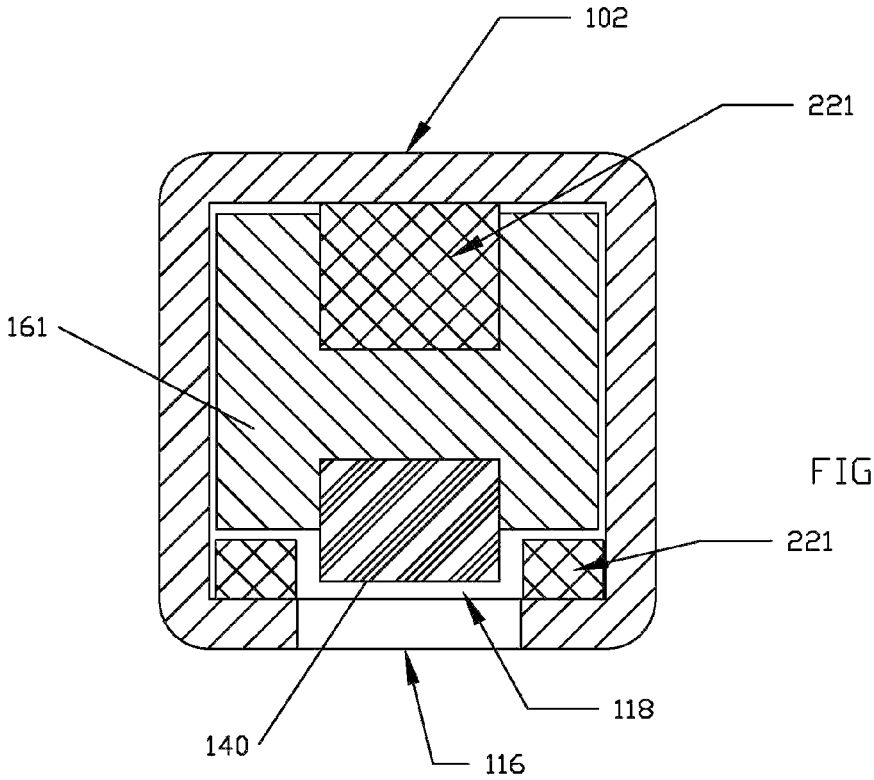
FIG. 10 is a schematic cross-section of the main body.
Figure 5:
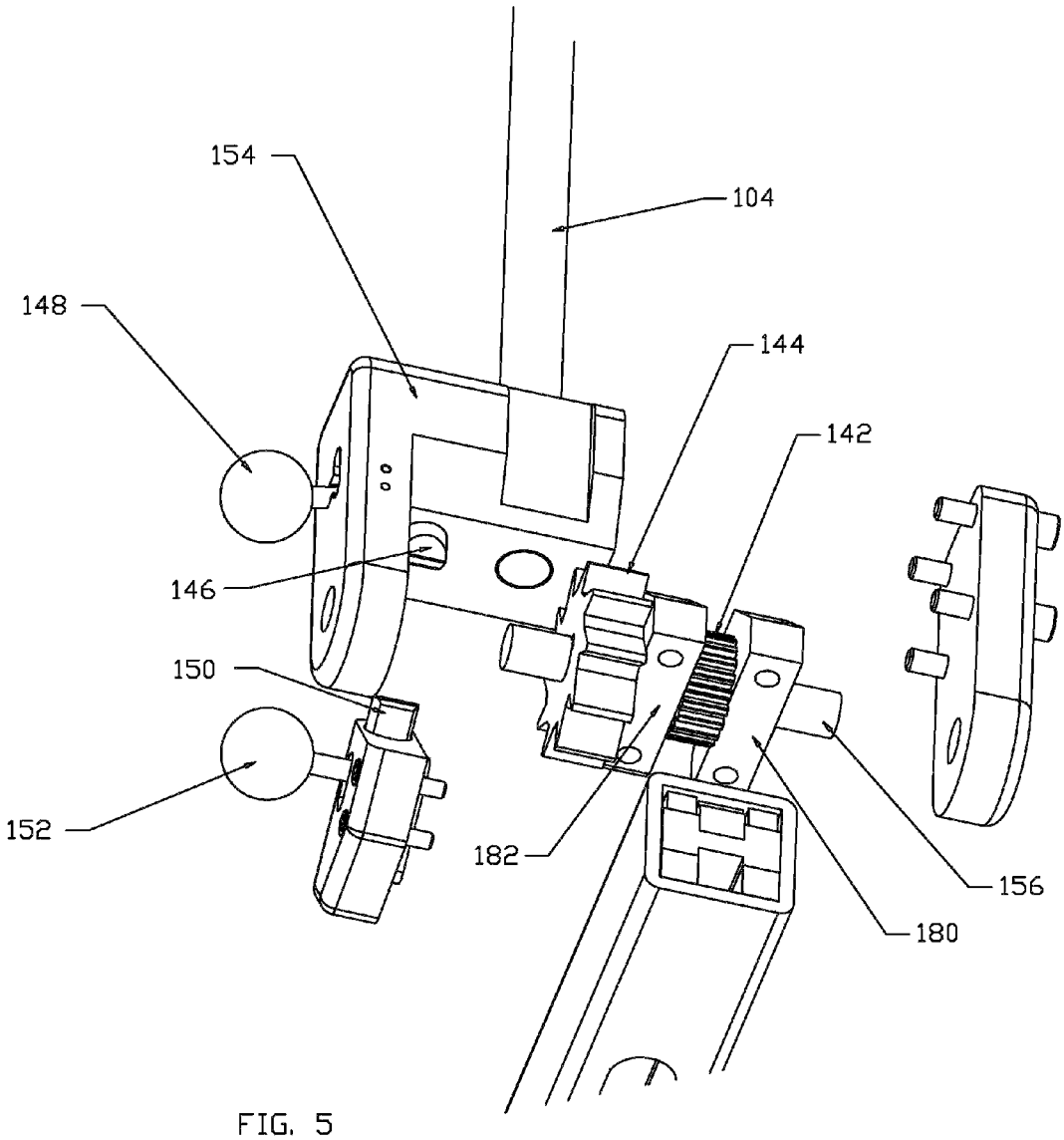
FIG. 5 is a perspective view of the lifting mechanism and of the release mechanism of the anchorage extractor.
Figure 6:
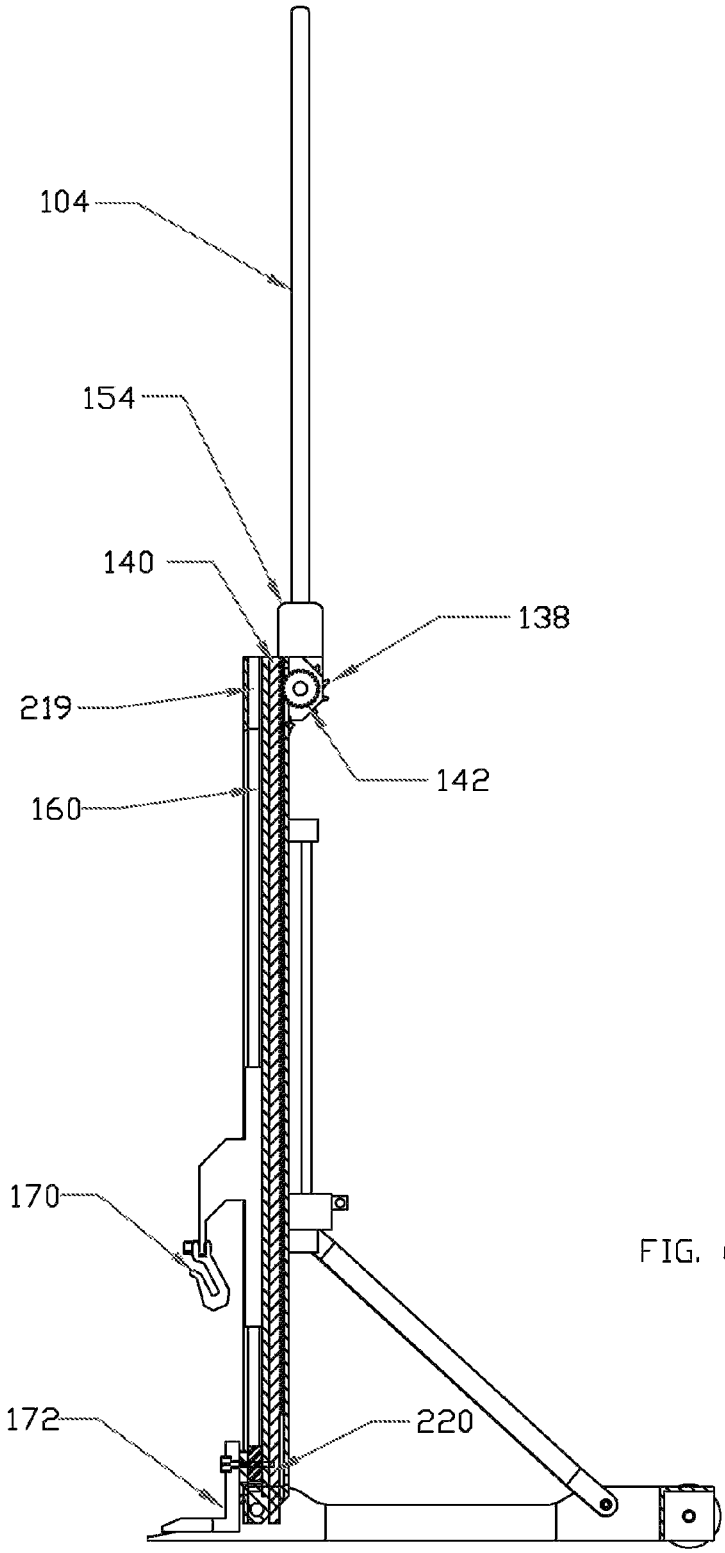
FIG. 6 is a sectional view of the anchorage extractor.

As shown in FIGS. 4, 5 and 6, the main body 102 comprises a longitudinal cavity 118 and an opening 116 where the drive wheel 144 interacts with the rack 140. A rack 140 and a plate 160, which are fixed to each other, are located in the cavity 118. In FIG. 10, is it shown that the rack 140 is connected to the rack support structure 161. The rack support structure 161 slide on the low-friction material block 221.

Figure 7:
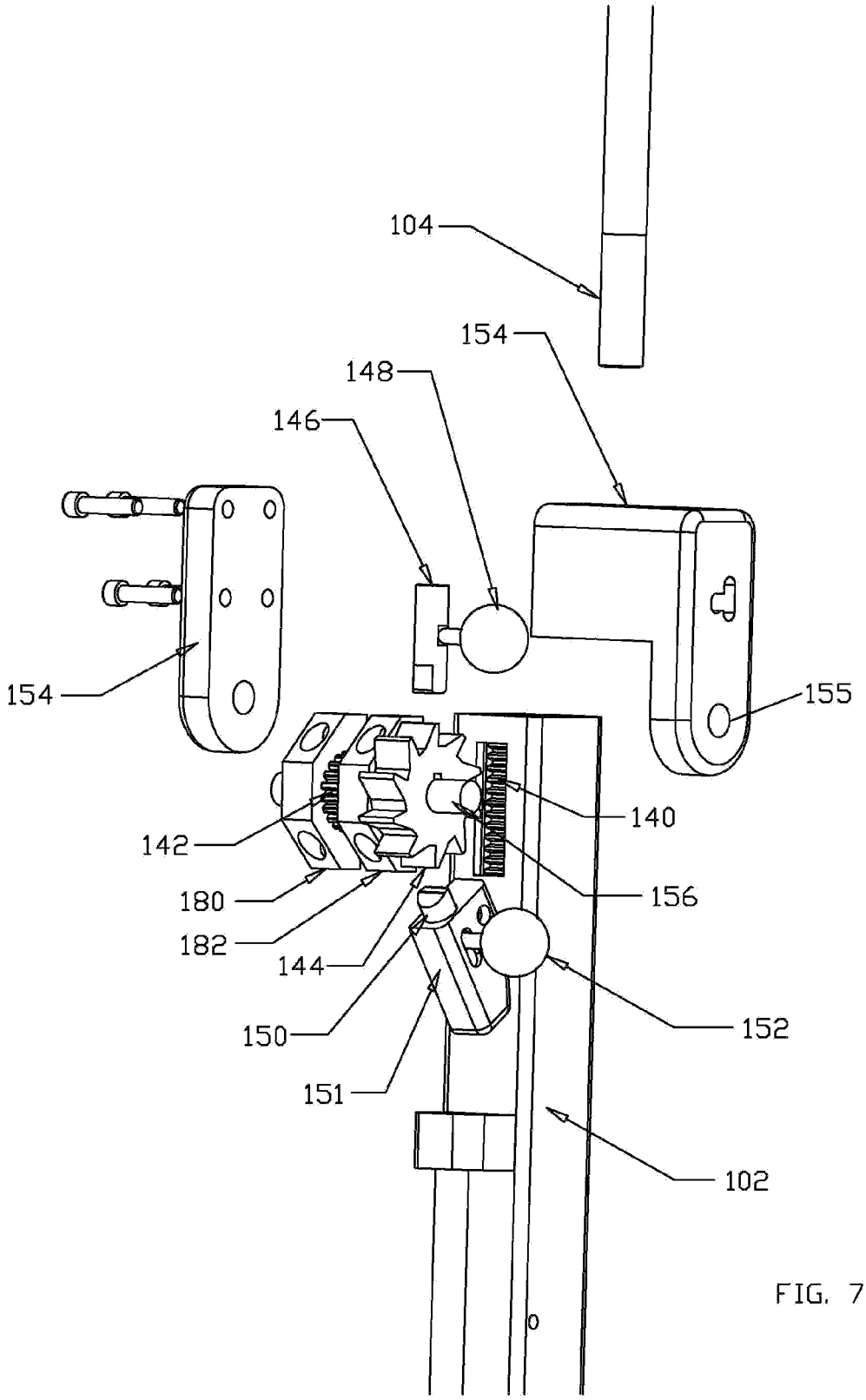
FIG. 7 is an exploded view of a portion of the anchorage extractor.

FIG. 7 shows the driving mechanism 138, which includes a first gear or drive wheel 144, a first lever 104, the rack 140, a second gear (or sprocket) 142, and a shaft 156. The sprocket 142 and the drive wheel 144 are connected to the shaft 156. The mounting blocks 180 and 182 are mounted on the shaft 156. The rotating block 154 comprises a hole 155 that is adapted to receive the shaft 156. The shaft 156 rotates in the hole 155. The first lever 104 is connected to the rotating block 154. A first lever-lock 146, controlled by the second lever or handle 148, is connected to the rotating block 154.

Attachment means or connector such as a hook 170 and/or a jaw 172, to which one or more anchorages are attached, is attached to the plate 160, shown in FIGS. 4 and 6. When the drive mechanism is actuated, by displacing upwardly and downwardly the first lever 104, the rack 140 is driven upward and thereby removes the anchorage from the ground.

To displace the rack 140, the first lever 104 is moved up and down. By lowering the first lever 104, the first lever-lock 146 contacts one of the teeth of the drive wheel 144 and the latter rotates along the shaft 156. The rotation of the drive wheel 144 causes the shaft 156 to rotate and this rotation is transmitted to the sprocket 142. The sprocket 142 is engaged with the rack 140 and drives the latter upward. The reduction ratio depends on the diameters of the drive wheel 144 and of the sprocket 142. In a preferred embodiment, the drive wheel 144 comprises less teeth than the sprocket 144.

The handle 148 of the first lever-lock 146 is automatically held in a locked position using a spring (not shown in the figures). The second lever-lock 150 is adapted to interact with the teeth of the drive wheel 144, it locks the drive wheel 144, and consequently the rack 140, to its current position and the first lever 104 may be raised again to transmit a further displacement to the rack 140. When the anchorage is removed from the ground, the release mechanism 151 allows the rack 140 to be repositioned to the starting position. The release mechanism 151 comprises the release lever 152 and the second lever-lock 150. By actuating the release lever 152, the second lever-lock 150 is disengaged from the drive wheel 144 and allows the latter to rotate freely and allow the rack 140 to go back to its rest or starting position.

To reduce the friction occurring between the plate 160 and the main body, strips or block 219 of a material having a very low coefficient of friction are connected to the main body or on the plate. This material may be, for example, UHMWPE.

To remove an anchorage from the ground, the user positions the extractor near the anchorage to be removed. The user adjusts the angle of the main body 102 to place it substantially parallel to the angle of the anchorage. The anchorage is connected to the extractor through the hook 170 or the jaw 172, or any other suitable means, depending on the physical configuration of the anchorage. It is possible to use an intermediary such as a chain to attach the anchorage to the hook 170 or the jaw 172.

At the starting or rest position, the rack 140 is ideally located at its lowest position relatively to the main body 102. The user moves the first lever 104 upwardly, this movement does not offer resistance, and then moves the first lever 104 downwardly, this movements driving the drive wheel 144 and moving upwardly the rack 140 within the cavity of the main body. Under the action of the sprocket on the rack, the rack slide upwardly.

To reposition the extractor to the starting position, the user actuates the release lever 152, allowing the rack 140 to move down freely.

Figure 8:
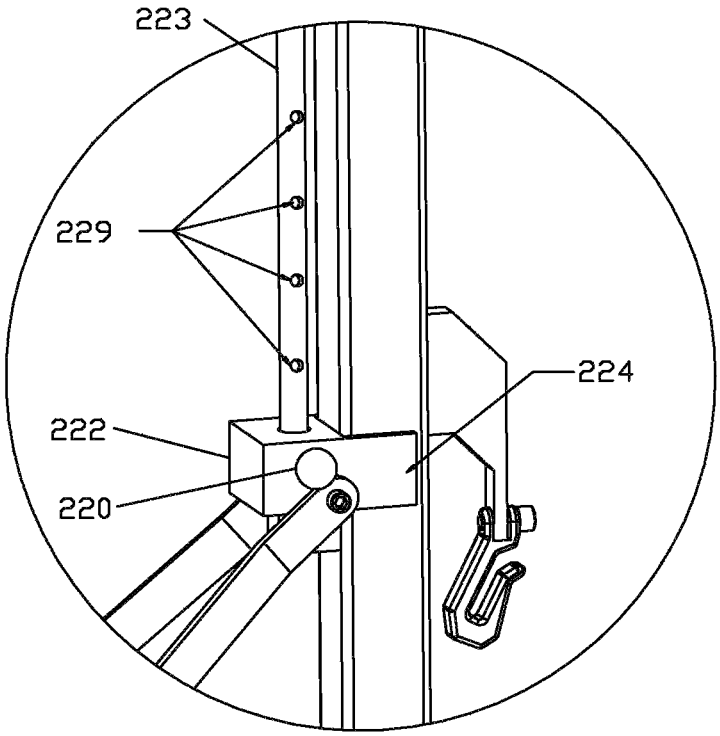
FIG. 8 is a perspective close-up view of the angle selector mechanism.
Figure 9A:
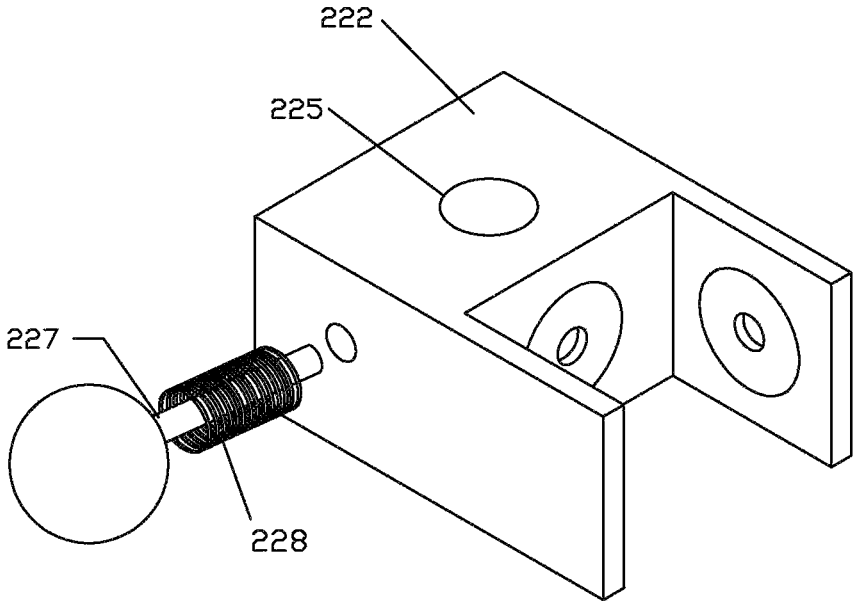
FIG. 9*a* is an exploded view of the angle selector mechanism.
Figure 9B:
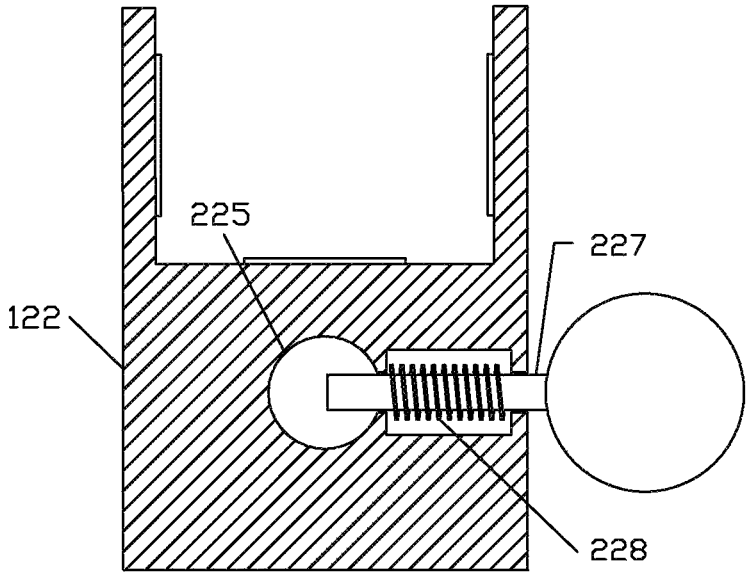
FIG. 9*b* is a cross-section view of the angle selector mechanism of FIG. 9*a*.

FIGS. 8 and 9 shows another embodiment of an angle selector for the main body. It comprises a sliding structure 222, an angle selector 220, a locking member 227, positioning plates 224 and a spring 228. The angle selector 220 is connected to the locking member 227. The sliding structure 222 comprises a hole 225 which is adapted to receive the guiding member 223. The plates 224 extend on both sides of the main body 102. The locking member 227 is partially contained in the sliding structure 222. The spring 228 is contained in a hole in the sliding structure 222 (shown at the exterior of the sliding structure in FIG. 9). The extremity of the locking member 227 is adapted to be received by one of the holes 229 in the guiding member 223. To change the angle of the main body, a user pulls the position selector 220, it will compress the spring 228, and displaces the sliding structure 222 upwardly or downwardly. The user let go the angle selector 220 when the main body is at the appropriate angle and the spring will force the locking member 227 to move towards the guiding member 223. When the locking member 227 faces one of the positioning holes 229, the extremity of the locking member 227 engages with the hole and locks the main body at the selected position or angle. It is to be noted that the sliding structure may be made in one block or more, depending of the design.

While illustrative and presently preferred embodiment(s) of the invention have been described in detail hereinabove, it is to be understood that the inventive concepts may be otherwise variously embodied and employed and that the appended claims are intended to be construed to include such variations except insofar as limited by the prior art.

The invention claimed is:

1. An extractor for removing an anchorage, said anchorage being installed in the ground and said anchorage having a longitudinal axis, said extractor comprising:

a. a main body;

b. a rack slidingly mounted to said main body;

c. a shaft rotatively mounted to said main body;

d. a sprocket fixedly mounted to said shaft, said sprocket engaging said rack;

e. a driving wheel fixedly mounted to said shaft;

f. a housing rotatively mounted to said shaft, said housing being rotatable in a first direction and in a second direction;

g. a first lever mounted to said housing for rotating said housing in said first and second directions;

h. a first lever-lock slidingly mounted to said housing, said first lever-lock being configured to drivingly engage said driving wheel in only one of said first and second directions in which said housing can be rotated;

i. a connector configured to engage said anchorage, said connector being connected to said rack;

j. a base connected to said main body, said base being configured to be in contact with said ground;

k. an elongated guiding member connected to said main body and extending substantially parallel to said main body, said guiding member comprising a plurality of positioning holes, each of said positioning holes corresponding to a different angular position of said main body;

l. a sliding structure slidingly mounted to said guiding member, said sliding structure comprising a locking member for selectively engaging one of said positioning holes;

m. a pivoting member pivotally connected to said, sliding structure and to said base;

wherein when said housing is rotated in said only one of said first and second directions, said first lever-lock drivingly engages said driving wheel and causes said shaft and said sprocket to rotate, and wherein the rotation of said sprocket drives said rack and said connector upwardly, thereby pulling said anchorage from said ground.

2. The extractor as claimed in claim 1, further comprising a second lever to release said first lever-lock.

3. The extractor as claimed in claim 1, further comprising a second lever-lock cooperating with said driving wheel, said second lever-lock blocking the rotation of said driving wheel when said housing is rotated in the other of said first and second directions.

4. The extractor as claimed in claim 3, further comprising a release lever, said release lever releasing said second lever-lock from blocking said rotation of said driving wheel.

5. The extractor as claimed in claim 1, wherein said main body comprises a cavity, and wherein said rack is located in said cavity.

6. The extractor as claimed in claim 1, further comprising a plurality of low-friction material blocks located between said rack and said main body.

7. An extractor for removing an anchorage, said anchorage being installed in the ground and said anchorage having a longitudinal axis, said extractor comprising:

a. a main body, said main body comprising a plurality of positioning holes, each of said positioning holes corresponding to a different angular position of said main body;

b. a rack slidingly mounted to said main body;

c. a shaft rotatively mounted to said main body;

d. a sprocket fixedly mounted to said shaft, said sprocket engaging said rack;

e. a driving wheel fixedly mounted to said shaft;

f. a housing rotatively mounted to said shaft, said housing being rotatable in a first direction and in a second direction;

g. a first lever mounted to said housing for rotating said housing in said first and second directions;

h. a first lever-lock slidingly mounted to said housing, said first lever-lock being configured to drivingly engage said driving wheel in only one of said first and second directions in which said housing can be rotated;

i. a connector configured to engage said anchorage, said connector being connected to said rack;

j. a base connected to said main body, said base being configured to be in contact with said ground;

k. an elongated guiding member connected to said main body and extending substantially parallel to said main body;

l. a sliding structure slidingly mounted to said guiding member, said sliding structure comprising a locking member for selectively engaging one of said positioning holes;

m. a pivoting member pivotally connected to said sliding structure and to said base;

wherein when said housing is rotated in said only one of said first and second directions, said first lever-lock drivingly engages said driving wheel and causes said shaft and said sprocket to rotate, and wherein the rotation of said sprocket drives said rack and said connector upwardly, thereby pulling said anchorage from said ground.

8. The extractor as claimed in claim 7, further comprising a second lever to release said first lever-lock.

9. The extractor as claimed in claim 7, further comprising a second lever-lock cooperating with said driving wheel, said second lever-lock blocking the rotation of said driving wheel when said housing is rotated in the other of said first and second directions.

10. The extractor as claimed in claim 9, further comprising a release lever, said release lever releasing said second lever-lock from blocking said rotation of said driving wheel.

11. The extractor as claimed in claim 7, wherein said main body comprises a cavity, and wherein said rack is located in said cavity.

12. The extractor as claimed in claim 7, further comprising a plurality of low-friction material blocks located between said rack and said main body.

* * * * *